United States Patent [19]

Bilt

[11] Patent Number: 4,672,773

[45] Date of Patent: Jun. 16, 1987

[54] MOTOR-OPERATED SLIDING DOOR ASSEMBLY

[76] Inventor: Michael M. Bilt, 2717 SW. 23rd Cranbrook Rd., Boynton Beach, Fla. 33436

[21] Appl. No.: 896,014

[22] Filed: Aug. 13, 1986

[51] Int. Cl.[4] ..... E05F 11/00

[52] U.S. Cl. ..... 49/358; 49/139

[58] Field of Search ..... 49/358, 139, 359

[56] References Cited

U.S. PATENT DOCUMENTS

| | | | |
|---|---|---|---|
| 1,631,416 | 6/1927 | Howard | 49/358 |
| 1,694,431 | 12/1928 | Russel et al. | 49/358 |
| 3,257,756 | 6/1966 | Mealer | 49/264 |
| 3,462,883 | 8/1969 | Reeks et al. | 49/360 |
| 3,606,699 | 9/1971 | Robinson, Jr. | 29/280 |
| 3,775,906 | 10/1973 | Dougherty | 49/358 |
| 4,162,592 | 7/1979 | Taniwaki | 49/358 |
| 4,520,592 | 6/1985 | Holloway | 49/358 |

OTHER PUBLICATIONS

Bulletin/Norco Manufacturing Corporation, "Norco Electric Door Wheelers".

Bulletin/M. Bilt Enterprise, "Well Bilt Hangar Door Systems".

*Primary Examiner*—Philip C. Kannan

*Attorney, Agent, or Firm*—Oltman and Flynn

[57] ABSTRACT

A horizontally sliding door section with a floor-engaging wheel driven from a motor. The wheel and its drive are located within the front-to-back extent of the door section in a housing hinged at one end on the bottom of the frame of the door section. A lead screw operated by a manual crank can be used to pivot the housing up about its hinge to raise the wheel from engagement with the floor of the building. The housing for the wheel has a removable front wall which carries the front bearing for the axle of the wheel, so that removal of this front wall disengages this bearing from the wheel axle.

9 Claims, 6 Drawing Figures

MOTOR-OPERATED SLIDING DOOR ASSEMBLY

This invention relates to a motor-operated sliding door assembly, such as for an aircraft hangar.

BACKGROUND OF THE INVENTION

Previously, sliding doors on aircraft hangars have been equipped with electric-motor operated drives mounted on the inside or outside of the door and having a rubber-tired motor-driven wheel engaging the floor. One problem with such drives is that they project beyond the door at the side of the door (i.e., inside or outside) on which they are mounted. This imposes engineering design limitations on doors of this type in which one "master" leaf (a sliding door section carrying the motorized drive unit) operated several other "slave" leaves (sliding door sections with pickup brackets which cause each successive sliding door section to engage the next one as they slide open or closed). Usually the master leaf carrying the motor drive is slidable on the outside of the other leaves of the door.

SUMMARY OF THE INVENTION

This invention relates to a motor-operated sliding door having a motorized drive unit that fits completely within the thickness of the door from front-to-back (i.e., outside-to-inside) so that there is no interference between the drive unit on a master leaf and any of the door leaves operated by it.

Another feature of this invention is a novel arrangement enabling the rubber-tired wheel of the drive unit to be raised off the floor, thereby enabling the door to be operated by a person pushing on it if the motor-operated drive unit becomes disabled.

Another aspect of this invention is the provision of a readily removable front cover on the housing of the drive unit which carries the anti-friction bearing of the motor-driven wheel for quick access to the wheel bearings and the tire.

Further objects and advantages of this invention will be apparent from the following detailed description of a presently-preferred embodiment, shown in the accompanying drawings.

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

DETAILED DESCRIPTION

Figure 1:
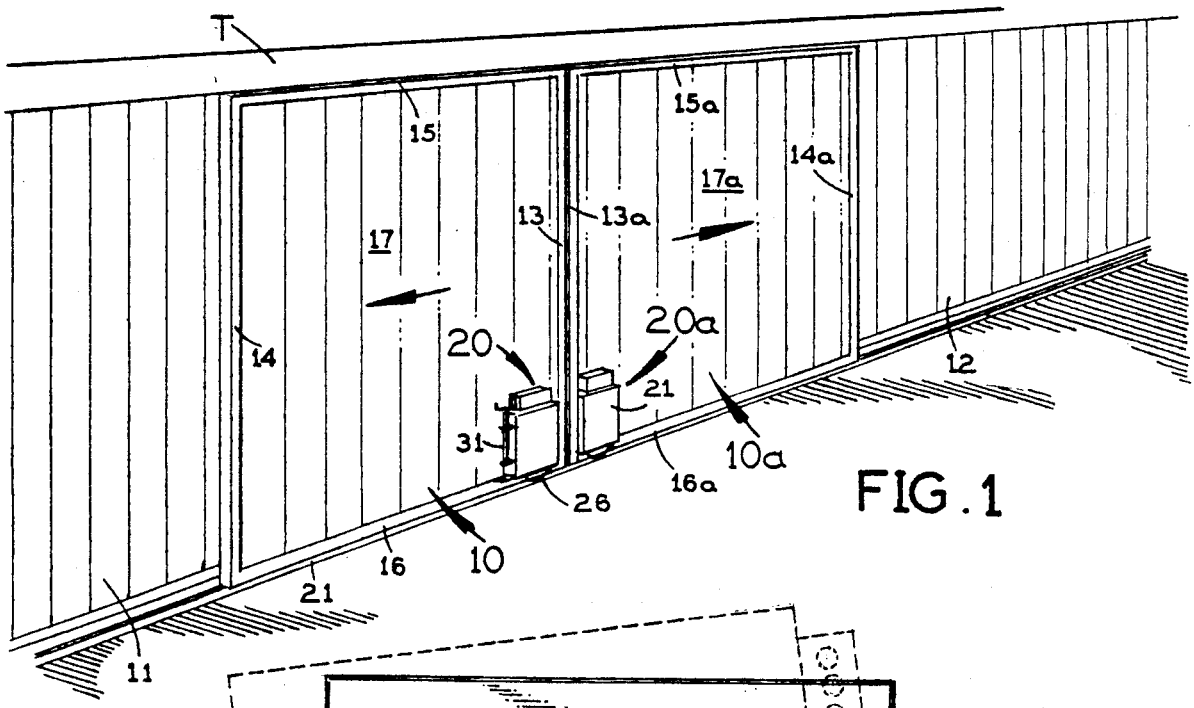
FIG. 1 is a perspective view from the inside of a building having two motor-operated sliding doors in accordance with the present invention.

FIG. 1 shows four neighboring doors on a building, such as an aircraft hangar. These doors include a first motor-operated sliding door section or master leaf 10 which can be slid to the left on the outside or inside of a door section 11 next to it, and a second motor-operated door section or master leaf 10*a* which can be slid to the right on the outside or inside of a door section 12 next to it. FIG. 1 shows all the door sections closed, with the two motor-operated door sections 10 and 10*a* abutting end-to-end.

The motor-operated door section 10 has the usual hangar door construction, with a rectangular marginal frame made up of vertically elongated opposite end pieces 13 and 14, a horizontally elongated top piece 15 and a horizontally elongated bottom piece 16. The top and side frame pieces are of generally rectangular hollow cross-section with a front-to-back dimension of about 10 inches. The bottom piece 16 of the door frame is a rigid flat piece with the same front-to-back dimension as the top and side pieces. A relatively thin sheet metal "skin" 17 is fastened to the frame at the outer side of the building.

The other motor-operated door section 10*a* has the same construction and is a mirror image of door section 10. Elements of door section 10*a* which correspond to the elements of door section 10 are given the same reference numerals with an "a" suffix added.

The top pieces 15 and 15*a* of door sections 10 and 10*a* are slidable along respecting horizontal tracks T of conventional design which are fixedly mounted on the building above these door sections.

The door mover or operator for the sliding door section or master leaf 10 is designated generally by reference numeral 20 in FIG. 1. The door mover or operator for the sliding door section or master leaf 10*a* is designated generally by the reference 20*a*. Elements of the door mover 20*a* which correspond to those of door mover 20 will be given the same reference numerals but with an "a" suffix.

Figure 2:
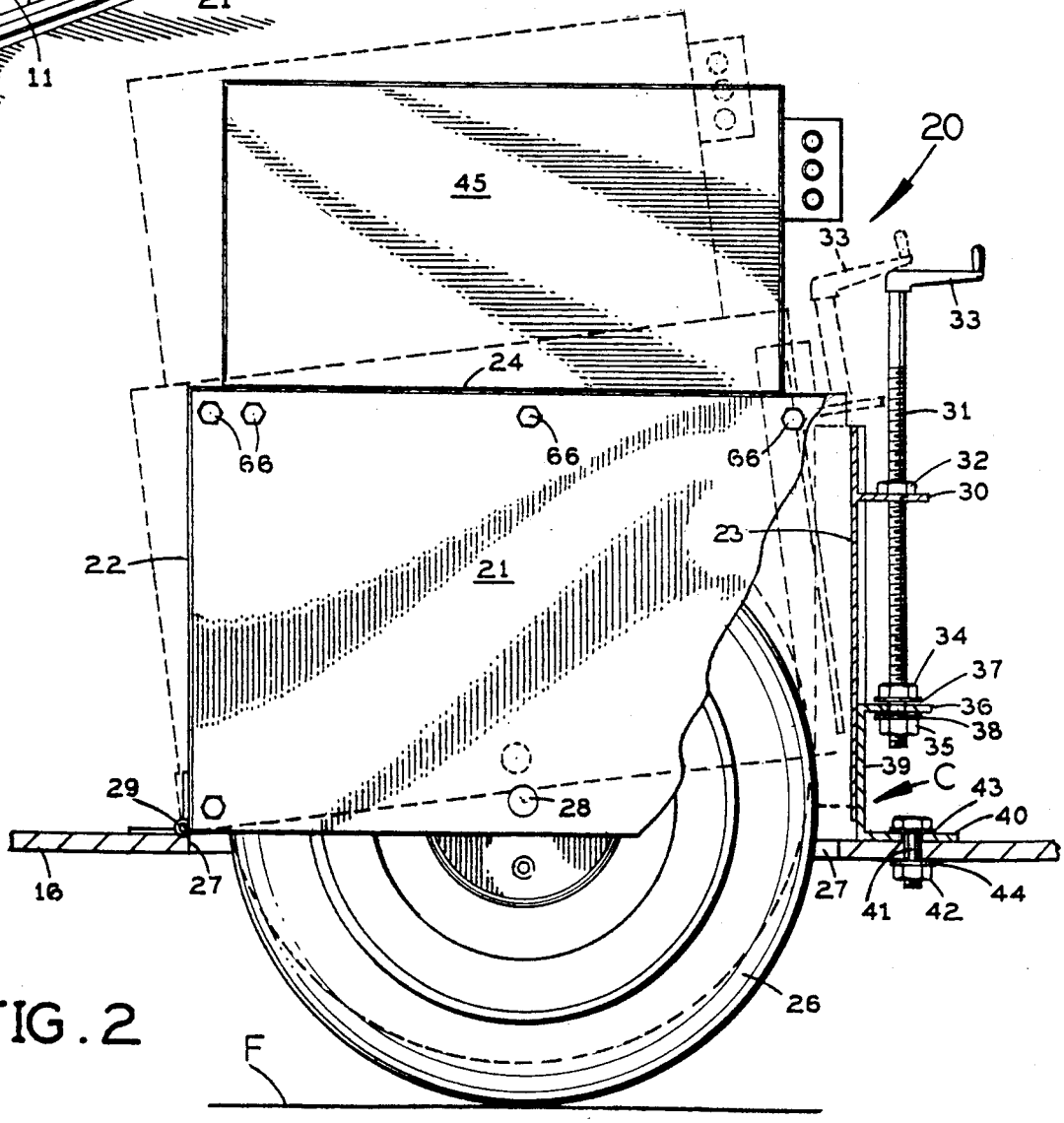
FIG. 2 is an elevational view of one of the door movers in FIG. 1, with parts broken away for clarity, showing the operative position in full lines and the non-operative position in phantom.
Figure 3:
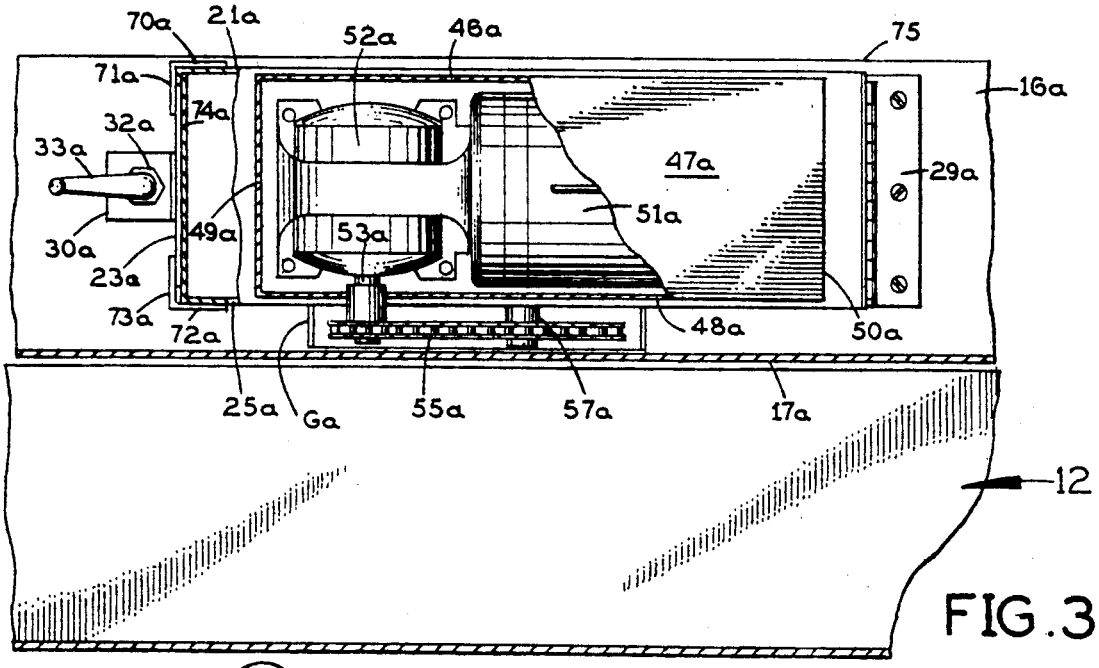
FIG. 3 is a horizontal cross-section through a door equipped with this door mover after it has slid to a position in front of the door next to it in FIG. 1.
Figure 5:
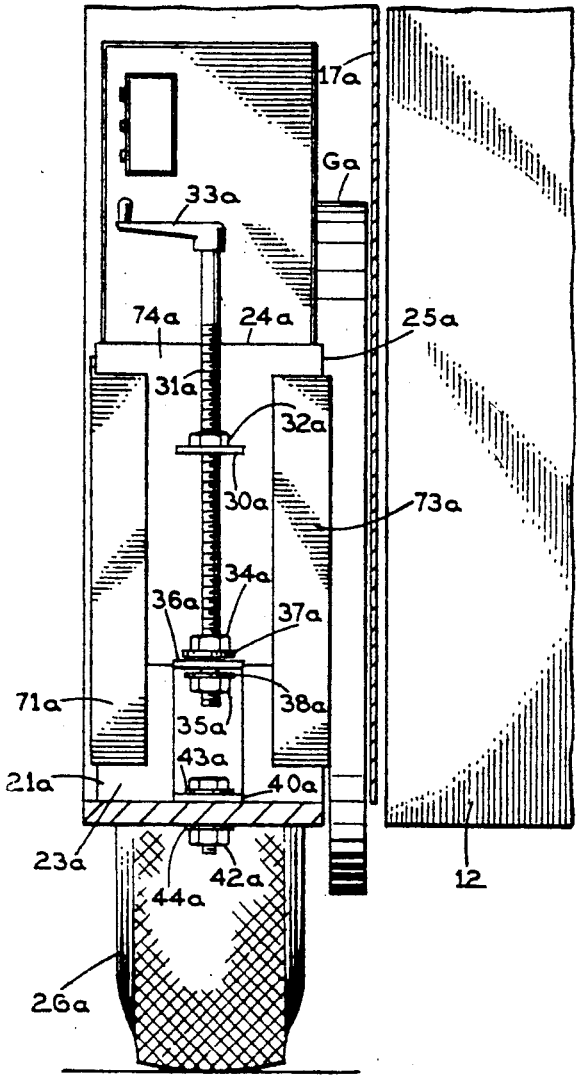
FIG. 5 is a vertical cross-section taken along the line 5—5 in FIG. 4.
Figure 6:
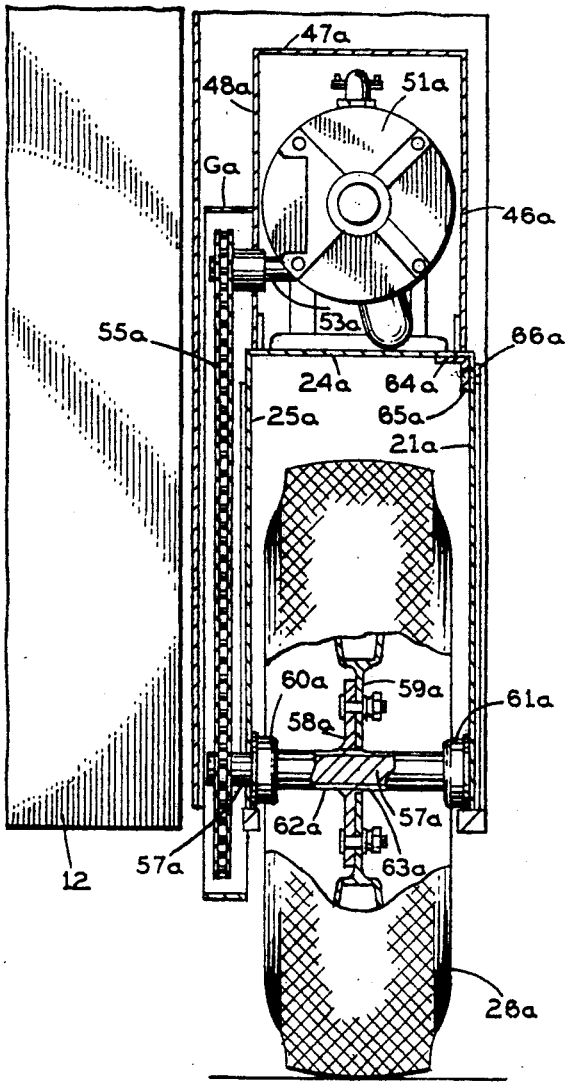
FIG. 6 is a vertical cross-section taken along the line 6—6 in FIG. 4.

Referring to FIG. 2, the door mover 20 for door section 10 has a generally rectangular wheel housing with a flat, detachable front cover 21, flat opposite vertical end walls 22 and 23 extending up behind the front wall, and a flat horizontal top wall 24 extending between the end walls behind the front wall. This housing also has a flat rear wall which does not appear in FIG. 2. (This rear wall corresponds to the rear wall 25*a* of the wheel housing of the door mover 10*a*, as shown in FIGS. 3, 5 and 6.) The wheel housing is open at the bottom to pass slightly less than the lower half of a rubber-tired wheel 26 for engaging the floor F of the building below the bottom piece 16 of the frame of this door section. The bottom piece 16 of the door frame has an oblong opening 27 for passing the lower part of the rubber-tired wheel 26, as shown in FIG. 2. The wheel 26 is rotatably mounted in this wheel housing for rotation about a horizontal axis 28 extending from front to back, as described in detail hereinafter with reference to the identical door mover on the other motor-operated sliding door section 10*a*.

As shown in FIG. 2, the left end wall 22 of the wheel housing of door mover 20 is connected by a hinge 29 at its lower end to the top face of the bottom piece 16 of the door frame, so that this housing can be pivoted from the operative full-line position to the position shown in phantom, in which the rubber-tired wheel 26 is raised a short distance off the floor F.

The opposite end wall 23 of this housing rigidly supports an outwardly extending horizontal plate 30 formed with a central opening through which a vertical lead screw 31 extends loosely. A nut 32, welded to the top of plate 30, threadedly engages the lead screw 31. A crank 33 on the upper end of the lead screw enables it to be turned in the nut 32. A pair of closely spaced nuts 34 and 35 are welded to the lead 31 screw near its lower end. These nuts are located respectively above and below the apertured horizontal top leg 36 of a channel C. The lead 31 screw passes down freely through a substantially larger opening in the channel leg 36. Flat metal washers 37 and 38 are engaged between the nuts 34 and 35 and the top and bottom faces, respectively, of the channel leg 36 with enough clearance that the lead screw 31 can tilt from the vertical position, shown in full lines, to the position shown in phantom lines in FIG. 2. Channel C has a vertical leg 39 which extends down from its apertured top leg 36 just outside the housing end wall 23, Channel C has an apertured horizontal bottom leg 40 which engages the top face of the bottom piece 16 of this door section immediately to the right of the opening 27. A bolt 41 extends down through the hole in the bottom leg 40 of channel C and a registering hole in the door piece 16. A nut 42 threadedly engages this bolt below the door piece 16. Upper and lower flat metal washers 43 and 44 are clamped loosely, respectively, between the door piece 16 and the head of bolt 41 above and nut 42 below.

With this arrangement the channel C is rigidly attached to the bottom piece 16 of the door frame and it holds nuts 34 and 35 (which are rigidly joined to the lead screw 31) fixidly positioned above the door piece 16. Rotation of lead screw 31 in one direction causes it to draw the wheel housing-attached nut 32 upward, causing the wheel housing 21–24 to pivot counterclockwise on hinge 29. This pivotal movement of the wheel housing, which tilts the lead screw 31 from the vertical position shown in full lines in FIG. 2, is made possible by the clearance or "play" between the lead screw and the apertured top leg 36 of channel C and the clearance between nuts 34 and 35 and this leg of the channel. Such movement of the wheel housing raises the wheel 26 off the floor to a non-operative position, shown in phantom in FIG. 2.

Rotation of the lead screw 31 in the opposite direction lowers the drive wheel 26 back down into engagement with the floor. The downward force which drive wheel 26 exerts on the floor can be adjusted by turning the lead screw.

Referring to FIG. 6, the motor housing 45*a* in the door mover or operator 20*a* for door section 10*a* has a vertical front wall 46*a*, a horizontal top wall 47*a*, a vertical rear wall 48*a*, and (FIG. 4) opposite vertical end walls 49*a* and 50*a*. Inside this housing an electric motor 51*a* (FIGS. 4 and 6) is mounted on the top wall 24*a* of the wheel housing. The rotary horizontal output shaft of this motor drives reduction gearing in a gear box 52*a* (FIG. 4) having a rotary horizontal output shaft 53*a* carrying a pinion gear 54*a* which drivingly engages the upper end of an endless drive chain 55*a*. The drive chain passes down around a larger gear 56*a* rigidly mounted on the axle 57*a* of wheel 26*a*. As shown in FIG. 6, the wheel axle 57*a* has a transverse vertical plate 58*a* about midway along its length which is bolted to the hub 50*a* of wheel 26*a*.

The drive chain 55*a*, the pinion gear 54*a* and the larger gear 56*a* are partly enclosed by a chain guard Ga (FIGS. 3, 4 and 6) in the form of a wall of oblong shape which is rigidly attached to, and extends rearward from, the motor housing and the wheel housing. This chain guard is open at the back to permit ready access to the gear and chain.

The wheel axle 57*a* is rotatably supported by a housing-attached anti-friction bearing assembly which has a ball bearing or roller bearing 60*a* at the rear end of the axle (near the drive chain 55*a*) and a ball bearing or roller bearing 61*a* at the front end of the axle. A cylindrical bushing 62*a*, which extends forward from bearing 60*a*, and a cylindrical bushing 63*a*, which extends rearward from bearing 61*a*, rotatably receive the axle 57*a* on opposite sides of its transverse plate 58*a*. The housing of anti-friction bearing 60*a* is welded to the inside of the rear wall 25*a* of the wheel housing. The housing of anti-friction bearing 61*a* is welded to the inside of the front wall 21*a* of the wheel housing.

As shown in FIG. 6, an angle iron of right-angled cross-section has a horizontal top leg 64*a* welded to the bottom face of the top wall 24*a* of the wheel housing and a vertical front leg 65*a* extending down from the front edge of top wall 24*a*. The front wall 21*a* of the wheel housing is rigidly attached to the front leg 65*a* of the angle iron by sheet metal screws 66*a* at intervals across the top of front wall 21*a*. By removing these screws the front wall 21*a* may be removed from the remainder of the wheel housing. The axle bearing 61*a* is removed in unison with front wall 21 because the housing of this bearing is welded to wall 21*a*. This exposes the wheel 26*a* at the front of the wheel housing for replacement or servicing.

At the end of the wheel housing where the lead screw 31*a* is located, a vertically elongated angle iron of right-angled cross-section presents a flat vertical front leg 70*a* (FIG. 3) which extends contiguously in front of this end of the front cover 21*a* and a flat vertical end leg 71*a* (FIGS. 3 and 5) which is spaced a short distance outside the end wall 23*a* of the wheel housing. At the back corner on this end of the wheel housing a second angle iron of the same type presents a flat vertical back leg 72*a* (FIGS. 3 and 4) extending immediately behind the rear wall 25*a* of the wheel housing and a flat vertical end leg 73*a* (FIGS. 3 and 5) which is spaced a short distance beyond the wheel housing's end wall 23*a*. A flat vertical plate 74*a* (FIGS. 3 and 5) is sandwiched between the housing end wall 23*a* and the end legs 71*a* and 73*a* of the two corner angle irons. Plate 74*a* is welded to the two corner angle irons and it extends down directly behind the vertical leg 39*a* of channel Ca, as shown in FIG. 4.

A very important feature of the present invention is that the motorized door mover is completely within the thickness of the door section which carries it. This is shown clearly in FIG. 3 from which it will be apparent that the front edge 75 of the bottom piece 16 of the door frame is beyond the forward-most part of the door mover assembly, which is the front leg 70*a* of the angle iron at a front corner of the wheel housing. Also, as shown in FIG. 1, there is a clearance between the rearward-most part of the door mover assembly, which is the chain guard G, and the skin 17*a* of this door section. Therefore, the door mover does not project beyond the door section either in front or in back but is completely disposed within the front-to-back thickness of the door section, so as not to interfere with or limit the sliding movement of this door section.

Figure 4:
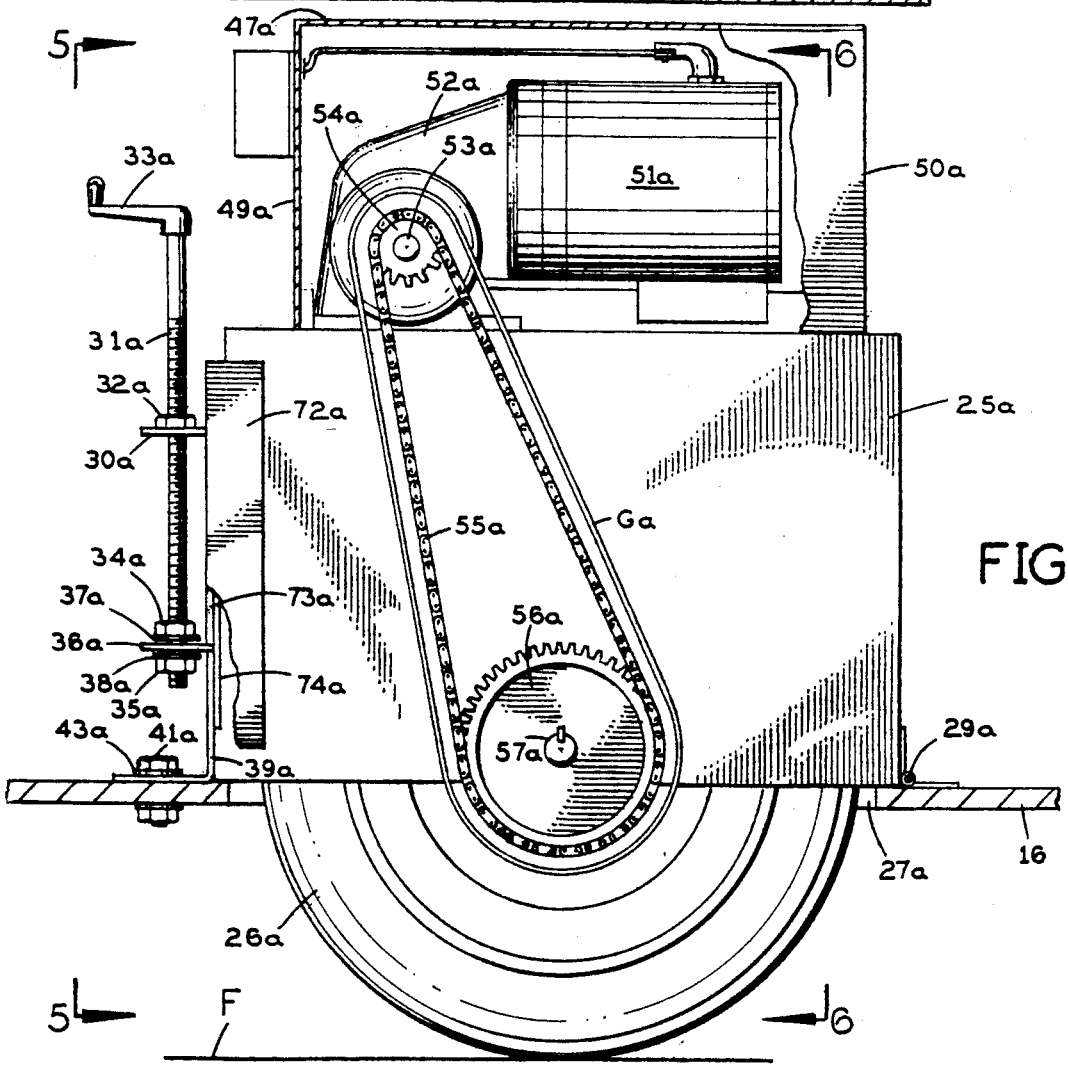
FIG. 4 is a view showing the FIG. 3 door mover partly in front elevation and partly in section.

FIGS. 3, 4 and 6 show the door section 10*a* slid to the right in Frame 1 from the position shown there to a position directly in front of the next door section 12.

If desired, the door sections 10*a* and 12 may have a conventional pick-up bracket arrangement for causing door section 10*a*, when it is substantially completely in front of door section 12, to engage door section 12 so that door section 12 slides in unison with door section 10*a* upon continued movement of door section 10*a* to the right in FIG. 1. The same is true of door sections 10 and 11. One or more additional sliding door sections may be positioned to the left of door section 11 in FIG. 1 and to the right of door section 12.

Alternatively, there may be a single motor-driven door at one end of a series of sliding door sections for causing those door sections to slide open in succession as the motor-driven door section moves in the door-opening direction.

I claim:

1. In a sliding door for use on a building having a floor and a door opening above said floor, and means for slidably supporting a door section for horizontal movement across said door opening, the improvement which comprises:

a door section having a peripheral frame with a top, bottom and opposite ends and a panel extending across the front of said frame, said frame having a predetermined extend from front to back;

a wheel spaced behind said panel and extending below said bottom of the door frame for rolling engagement with the floor of the building behind said door opening, said wheel having a horizontal axis of rotation extending substantially perpendicular to said panel;

a motor;

drive means acting between said motor and said wheel for imparting rotation to the wheel from the motor;

and housing means supporting said motor, drive means and wheel on the door section behind said panel;

said housing means, motor, drive means and wheel being completely disposed within the front-to-back extent of the door frame so as not to project beyond the door frame.

2. A sliding door according to claim 1, wherein:

said bottom of the door frame has an opening which is elongated parallel to said panel;

and said wheel projects down through said opening for rolling engagement with the floor.

3. A sliding door according to claim 1 and further comprising:

means for selectively raising said wheel on the door section to disengage the wheel from the floor.

4. A sliding door according to claim 3 wherein:

said means for selectively raising said wheel comprises manually operable crank-operated means acting between said bottom of the door frame and said housing means.

5. A sliding door according to claim 4 wherein said crank-operated means comprises:

a lead screw extending vertically along the outside of said housing means at one end of the latter;

a manual crank on the upper end of said lead screw for rotating the lead screw;

a rigid support member extending up from said bottom of the door frame and having a top wall with an opening which loosely passes the lower end of said lead screw;

a pair of nuts rigidly fastened to the lead screw above and below said top wall of said support member;

and an additional nut rigidly supported by said housing means at a location spaced below said crank and above said pair of nuts, said additional nut threadedly engaging said lead screw to be raised or lowered by rotation of the lead screw in one direction or the other;

and further comprising:

hinge means pivotally mounting the opposite end of said housing means on said bottom of the door frame.

6. A sliding door according to claim 5 wherein:

said housing means has vertical front and back walls;

said wheel has a horizontal axle extending between said front and back walls of said housing means;

and further comprising:

a first anti-friction bearing on the inside of said back wall and rotatably supporting said axle at its back end;

a second anti-friction bearing mounted on the inside of said front wall and rotatably supporting said axle at its front end;

and means detachably connecting said front wall to the remainder of said housing means, whereby removal of said front wall from the remainder of said housing means also removes said second bearing from said axle.

7. A sliding door according to claim 1 wherein:

said housing means has vertical front and back walls;

said wheel has a horizontal axle extending between said front and back walls of said housing means;

and further comprising:

a first anti-friction bearing on the inside of said back wall rotatably supporting said axle;

a second anti-friction bearing mounted on the inside of said front wall and rotatably supporting said axle at its front end;

and means detachably connecting said front wall to the remainder of said housing means, whereby removal of said front wall from the remainder of said housing means also removes said second bearing from said axle.

8. In a sliding door for use on a building having a floor and a door opening above said floor, and means for slidably supporting a door section for horizontal movement across said door opening, the improvement which comprises:

a door section having a peripheral frame with a top, bottom and opposite ends and a panel extending across the front of said frame, said frame having a predetermined extent from front to back, said bottom of the door frame having an opening therein which is elongated parallel to said panel;

a drive wheel behind said panel extending down through said opening in the bottom of the door frame for rolling engagement with the floor of the building behind said door opening, said wheel having a horizontal axis of rotation extending substantially perpendicular to said panel;

a motor behind said panel above said wheel;

drive means behind said panel acting between said motor and said wheel for imparting rotation to the wheel from the motor;

housing means supporting said motor, drive means and wheel on the door section behind said panel above said bottom of the door frame;

said housing means, motor, drive means and wheel being completely disposed within the front-to-back extent of the door frame so as not to project beyond the door frame;

a lead screw extending vertically along the outside of said housing means at one end of the latter;

a manual crank on the upper end of said lead screw for rotating the lead screw;

a rigid support member extending up from said bottom of the door frame and having a top wall with an opening which loosely passes the lower end of said lead screw;

a pair of nuts rigidly fastened to the lead screw above and below said top wall of said support member;

an additional nut rigidly supported by said housing means at a location spaced below said crank and above said pair of nuts, said additional nut threadedly engaging said lead screw to be raised or lowered by rotation of the lead screw in one direction or the other;

and hinge means pivotally mounting the opposite end of said housing means on said bottom of the door frame;

said lead screw when rotated in one direction pivoting said housing means up about said hinge means to raise said wheel from engagement with the floor.

9. A sliding door according to claim 8 wherein:

said housing means has vertical front and back walls;

said wheel has a horizontal axle extending between said front and back walls of said housing means;

a first anti-friction bearing on the inside of said back wall rotatably supporting said axle;

a second anti-friction bearing mounted on the inside of said front wall and rotatably supporting said axle at its front end;

and means detachably connecting said front wall to the remainder of said housing means, whereby removal of said front wall from the remainder of said housing means also removes said second bearing from said axle.

* * * * *